United States Patent [19]

Atherton et al.

[11] 4,410,421

[45] Oct. 18, 1983

[54] PROCESS FOR NITROGEN REMOVAL FROM HYDROCARBONACEOUS MATERIALS

[75] Inventors: Linda Atherton, Santa Clara County; Conrad J. Kulik, Alameda County, both of Calif.

[73] Assignee: Electric Power Research Institute, Palo Alto, Calif.

[21] Appl. No.: 346,926

[22] Filed: Feb. 8, 1982

[51] Int. Cl.[3] ..... C10G 25/00

[52] U.S. Cl. ..... 208/254 R; 208/307

[58] Field of Search ..... 208/254 R, 112, 307, 208/91, 99; 210/903

[56] References Cited

U.S. PATENT DOCUMENTS

| | | | |
|---|---|---|---|
| 2,384,315 | 9/1945 | Kuhl | 208/91 |
| 3,112,258 | 11/1963 | Strecker | 208/254 R |
| 3,367,862 | 2/1968 | Mason et al. | 208/243 |
| 3,542,669 | 11/1970 | DeFeo | 208/91 |
| 4,005,011 | 1/1977 | Sweeny | 210/18 |
| 4,334,976 | 6/1982 | Yan | 208/8 LE |

FOREIGN PATENT DOCUMENTS

| | | | |
|---|---|---|---|
| 935189 | 10/1973 | Canada | 208/91 |
| 53-132167 | 11/1978 | Japan | 210/903 |

OTHER PUBLICATIONS

Gitchel et al., "Characteristics of Active Carbon Regenerated by Wet Oxidation", AIChE Symposium Series, 1980, pp. 51–59.

*Primary Examiner*—Delbert E. Gantz
*Assistant Examiner*—O. Chaudhuri
*Attorney, Agent, or Firm*—Flehr, Hohbach, Test, Albritton & Herbert

[57] ABSTRACT

Hydrocarbonaceous material is contacted with particulate coal to cause said coal to sorb a substantial portion of the basic nitrogen compounds contained in said hydrocarbonaceous material.

16 Claims, 1 Drawing Figure

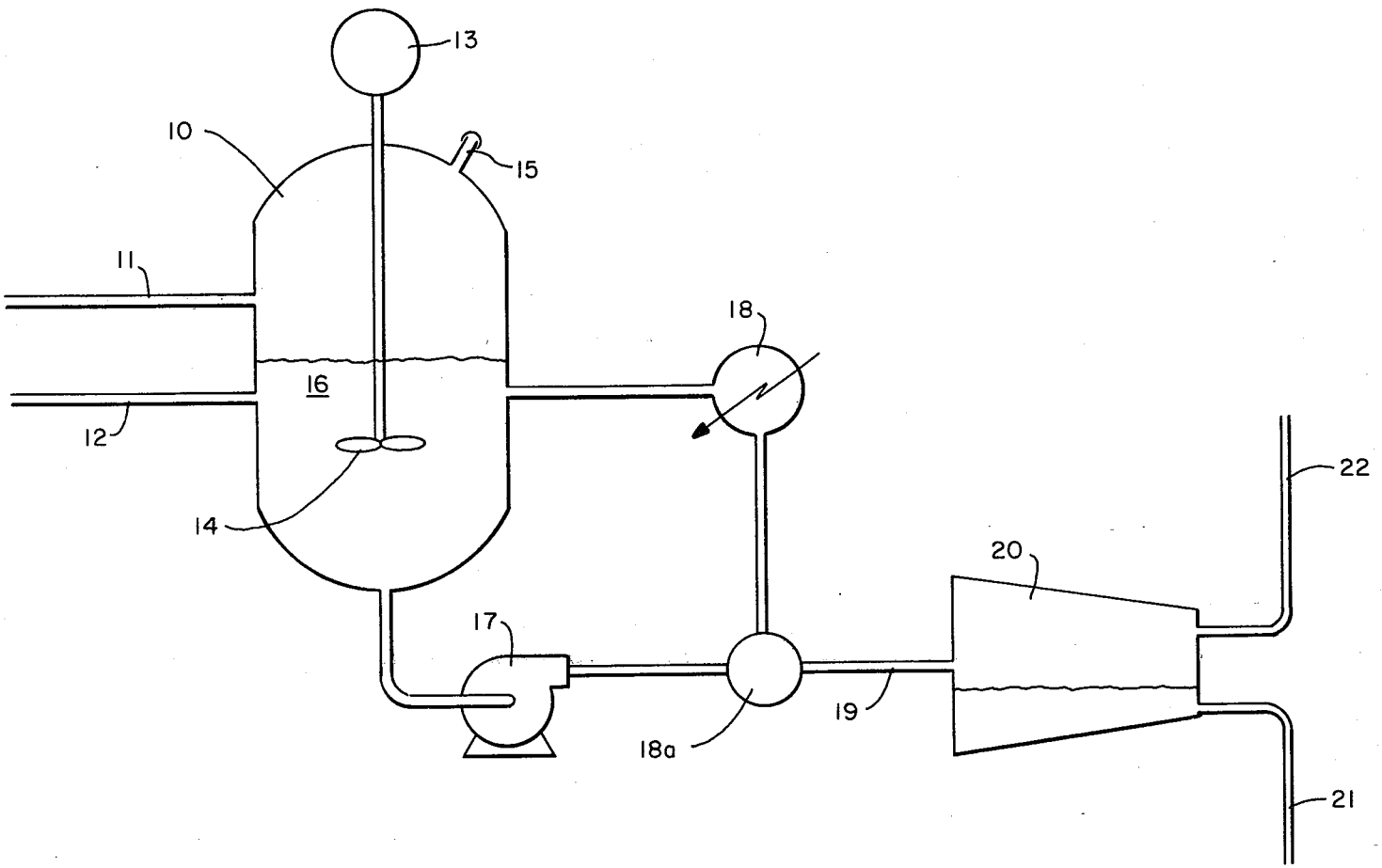
22
21
20
19
18
18a
17
15
13
16
14
10
11
12

PROCESS FOR NITROGEN REMOVAL FROM HYDROCARBONACEOUS MATERIALS

The present invention is directed to a method of improving the quality of hydrocarbonaceous material by removing basic nitrogen heteroatoms. More particularly, the invention relates to a process comprising contact of a hydrocarbonaceous material with coal for the purpose of basic nitrogen heteroatom removal.

In U.S. Pat. Nos. 4,261,813, 4,271,009, 4,272,361 and 4,827,051 there are disclosed methods of removing nitrogen-containing compounds from hydrocarbonaceous liquids by contacting said liquids with an acid solvent. In U.S. Pat. No. 4,268,378 there is disclosed a method for reducing the nitrogen content of shale oil by mild hydrogenation followed by liquid sulfur dioxide extraction. These methods of removing nitrogen from hydrocarbonaceous liquids involve not only specialized procedures, but also require special equipment, particularly for transferring the highly corrosive acid solvent.

The present invention is based in part on the discovery that basic nitrogen heteroatoms may be sorbed from hydrocarbonaceous material, particularly from coal-derived liquid, by contact with coal. The removal of such compounds improves the quality of the hydrocarbonaceous liquid in at least three ways. Firstly, if the liquid product is to be utilized for combustion, $NO_x$ emissions are minimized. Secondly, if the liquid product is to be upgraded further, hydrogen consumption will be minimized in that it no longer be required for nitrogen removal. Also, some nitrogen compounds are strongly absorbed on catalysts and therefore deactivate (poison) the catalyst. Basic nitrogen heterocyclic compounds are particularly undesirable for this reason. Other nitrogen-containing compounds, such as, ammonia and aliphatic amines are less deleterious on catalysts. Thirdly, in addition to catalyst poisoning and interfering with catalytic conversion, nitrogen-containing compounds can further cause product-instability in that these compounds which have the undesirable effect of increasing the viscosity of the hydrocarbonaceous liquid. Thus, the removal of nitrogen compounds reduces the viscosity of the liquid and also will prevent viscosity increases during storage.

It is therefore an object of the present invention to provide a method for improving the quality of hydrocarbonaceous materials by removing the basic nitrogen compounds therefrom.

In accordance with the present invention there is provided, a process comprising the step of contacting particulate coal with liquid-phase hydrocarbonaceous material containing basic nitrogen compounds, at a temperature ranging from about ambient to about 600° F. at atmospheric pressure for a period sufficient for the coal to substantially sorb the basic nitrogen compounds from the hydrocarbonaceous material. Subsequent to said treatment the improved hydrocarbonaceous material may be separated from the coal. If the hydrocarbonaceous material is used for combustion, it will exhibit low $NO_x$ emission due to the substantial absence of nitrogen compounds.

The term "coal" is intended to include all grades of coal such as anthracite, bituminous, semi-bituminous, subbituminous coal, lignite, peat and mixtures thereof. Application of the present invention, to bituminous, semi-bituminous, sub-bituminous coal, and lignite is particularly useful.

The accompanying FIGURE is an illustration of one embodiment of a means for accomplishing the method according to the present invention.

The present invention may be applied as a treatment for hydrocarbonaceous liquids, such as petroleum or petroleum-derived liquids, oil shale or oil shale-derived liquids, coal-derived liquids, byproducts of coke production or coal gasification, tar sands or tar sand-derived material. A preferred hydrocarbonaceous liquid is full-range coal-derived liquid. The invention is applicable to types of products derived from direct coal liquefaction processes. One of the types of such products is a coal-derived distillate (bp 400°–850° F.) which typically may contain about 70% hydrocarbons (hydro- and polyhydroaromatics), 8% heterocyclic compounds (mostly ethers), 10% monophenols (predominantly less than 10 carbon atoms) and 12% polyphenols and basic nitrogen compounds. Of these classes of compounds, about 30–50% of the total liquid may be composed of the following compounds: naphthalene, methylnaphthalene, biphenyl, diphenyl ether, phenathrene and/or anthracene, and pyrene. A substantial portion of the basic nitrogen compounds present may be quinolines.

Since such coal-derived liquid products may be lightly hydrogenated, the basic nitrogens are preferably in the form of partially hydrogenated heterocycles, such as, 1,2,3,4-tetrahydroquinolines, indolines, and the like. Preferably, the coal-derived liquid products are low in phenolic compounds which may inhibit or prevent the basic nitrogen sorption by coal.

The treatment of hydrocarbonaceous material with particulate coal according to the present invention will be conducted under relatively mild conditions because if the conditions are too severe, the nitrogen compounds will be redistributed between the hydrocarbonaceous material and the coal. We have therefore found that by subjecting the hydrocarbonaceous material to coal from about 1 to 180 minutes, usually less than 60 minutes at ambient to 600° F. and substantially atmospheric pressure, the basic nitrogen sorption is maximized, thereby providing an improved liquid product or hydrocarbonaceous fuel. The preferred sorption conditions are 300° F. for 60 minutes.

Referring to the Figure, there is illustrated a sorption tank 10 accommodated with inlets 11 and 12 for coal and liquid or slurried hydrocarbonaceous material, respectively. The hydrocarbonaceous material will contain basic nitrogen heteroatoms and may be, for example, coal-derived liquid products having a boiling point from 400°–1000° F. and preferably less than 5% by weight oxygen containing compounds. It is particularly preferred that the basic nitrogen compounds comprise partially hydrogenated heterocycles, such as 1,2,3,4-tetrahydroquinoline, indoline and the like. Sorption tank 10 is further equipped with motor 13, agitating means 14 and air vent 15. The coal and hydrocarbonaceous material mixture 16 may be pumped by pump 17 and recycled via valve means **18*a* through heating means 18 such that the mixture is maintained within a temperature range of ambient to 600° F. The pressure within tank 10 may be atmospheric and the mixture 16 may be agitated and heated at the aforementioned preferred temperature for a period of approximately 1 hour, after which time heating means 18 is bypassed via valve 18*a* and the mixture is conducted by line 19 into solids separation means 20 whereby the coal containing sorbed basic nitrogen compounds may be withdrawn via line 21 and conducted to slurry preparation means (not shown) for treatment by direct coal liquefaction processes or some other purpose. This hydrocarbonaceous material which is substantially depleted of basic nitrogen compounds may be withdrawn through line 22**.

The hydrocarbonaceous material treated according to the present invention may be further benefitted as previously described by repeating the process. Repetitive treatments are particularly desirable when the initial nitrogen compound content of the hydrocarbonaceous material is too high to be removed by one treatment.

Hydrocarbonaceous material prepared according to the present invention may be used as a combustion fuel since the removal of the basic nitrogen compounds minimize $NO_x$ emission and if further upgrading is required, the removal of the nitrogen bearing compounds will ultimately reduce hydrogen requirements for upgrading and improve the life of the upgrading catalyst.

If desired, the particulate coal may be provided substantially free of water prior to the sorption step. Drying of the coal may be accomplished by warming the coal in presence of an inert sweep gas prior to mixing with the hydrocarbonaceous stream.

The following example illustrates removal of 1,2,3,4-tetrahydroquinoline (THQ) from a hydrocarbonaceous liquid (1-methylnaphthalene) by contact with coals from various sources.

EXAMPLE

Twenty-five grams of a specific coal were added to fifty grams of 1-methylnaphthalene containing known concentrations of THQ. This slurry was then heated to, mixed and held at 200° F. for 3 hours. After cooling and filtration, the filtrate was analyzed for percent THQ content.

| WT % THQ IN METHYL-NAPHTHALENE PRIOR TO TREATMENT | TYPE OF COAL | WT % OF MOISTURE IN COAL BEFORE TREATMENT | WT % THQ IN METHYL-NAPHTHALENE FILTRATE |
|---|---|---|---|
| 1% | Indiana V (bituminous) | 5.1% | .035% |
| 1 | Kentucky 9 (bituminous) | 2.2 | .36 |
| 1 | Clovis Point (sub-bituminous) | 23.06 | 0.15 |
| 5 | Indiana V | 5.1 | 1.9 |
| 5 | Kentucky 9 | 2.2 | 2.4 |
| 5 | Clovis Point | 23.06 | 2.2 |

What is claimed is:

1. A process for removing basic nitrogen heterocyclic compounds from a hydrocarbonaceous material comprising the steps of contacting particulate coal with said hydrocarbonaceous material at a temperature from about ambient to 600° F. at substantially atmospheric pressure for a period of time sufficient for said coal to sorb a substantial portion of said basic nitrogen heterocyclic compounds, and separating said coal from said hydrocarbonaceous material.

2. The process according to claim 1 wherein said hydrocarbonaceous material comprises a full range coal-derived liquid.

3. The process according to claim 1 wherein said period of time is less than 180 minutes.

4. The process according to claim 3 wherein said period of time is 60 minutes.

5. The process according to claim 4 wherein said temperature is about 300° F.

6. The process according to claim 1 wherein said hydrocarbonaceous material comprises petroleum.

7. The process according to claim 1 wherein said hydrocarbonaceous material comprises a petroleum-derived liquid.

8. The process according to claim 1 wherein said hydrocarbonaceous material comprises oil shale-derived material.

9. The process according to claim 1 wherein said hydrocarbonaceous material comprises oil shale.

10. The process according to claim 1 wherein sad hydrocarbonaceous material comprises a byproduct of coke production.

11. The process according to claim 1 wherein said hydrocarbonaceous material comprises a byproduct of coal gasification.

12. The process according to claim 1 wherein said hydrocarbonaceous material comprises tar sands.

13. The process according to claim 1 wherein said hydrocarbonaceous material comprises tar sand-derived material.

14. The process according to claim 1 wherein said coal contacted with said hydrocarbonaceous material is substantially free of water.

15. The process according to claim 1 wherein said coal contacted with said hydrocarbonaceous material is undried coal.

16. The process according to claim 1 wherein subsequent to said separating step, the resultant hydrocarbonaceous material is again subjected to said contacting and separating steps.

* * * * *